US006056388A

United States Patent [19]

Maximovsky et al.

[11] Patent Number: 6,056,388

[45] Date of Patent: May 2, 2000

[54] METHOD OF INK-JET PRINTING AND AN INK-JET PRINTING HEAD FOR CARRYING OUT THE METHOD

[76] Inventors: Sergei Nikolaevich Maximovsky, ulitsa Skakovaya, d. 34, korpus 4, kv. 235; Grigory Avramovich Radutsky, ulitsa Pervomaiskaya, d. 66, kv. 45, both of Moscow, Russian Federation

[21] Appl. No.: 09/065,057

[22] PCT Filed: Nov. 27, 1995

[86] PCT No.: PCT/RU95/00249

§ 371 Date: Apr. 27, 1998

§ 102(e) Date: Apr. 27, 1998

[87] PCT Pub. No.: WO97/15450

PCT Pub. Date: Mar. 1, 1997

[30] Foreign Application Priority Data

Oct. 27, 1995 [RU] Russian Federation ..... 95117869

[51] Int. Cl.[7] ..... B41J 2/14

[52] U.S. Cl. ..... 347/51

[58] Field of Search ..... 347/50–55

[56] References Cited

U.S. PATENT DOCUMENTS

| | | | |
|---|---|---|---|
| 3,798,365 | 3/1974 | Browning et al. | 347/51 |
| 4,868,585 | 9/1989 | Nishikawa et al. | 347/55 |
| 4,887,400 | 12/1989 | Michaelis et al. | 346/140 |
| 4,897,665 | 1/1990 | Aoki | 346/1.1 |
| 5,130,726 | 7/1992 | Fukushima et al. | 346/140 |

FOREIGN PATENT DOCUMENTS

| | | | |
|---|---|---|---|
| 61-118273 | 6/1986 | Japan | 347/51 |
| 405193135 | 9/1993 | Japan | 347/51 |

*Primary Examiner*—John Barlow
*Assistant Examiner*—Charles W. Stewart, Jr.
*Attorney, Agent, or Firm*—Ostrolenk, Faber, Gerb & Soffen, LLP

[57] ABSTRACT

A method of ink-jet printing is carried out by focusing a light beam from a quantum generator onto an expendable liquid printing material in a jet from the direction of the open end of the jet, with an information carrier placed in front of the open end, in order to generate a pressure pulse ensuring the expulsion of a droplet of the liquid onto the carrier. The method is carried out by directing the light beam onto the material in a jet either at an angle to its surface between the jet and the carrier, or through a carrier which is transparent to the wavelength of the beam. An ink-jet printing head has rows of jets, each with one blind end formed in the body of a driving drum. The head is provided with means for feeding the expendable liquid printing material into the jets through their open ends and with means for generating a pressure pulse in the jets, the latter means comprising a quantum generator of a light beam with a device for focusing the beam onto the liquid material from the direction of the jets' open end in front of which the carrier is located, and with a means for deflecting the light beam over the ends.

15 Claims, 1 Drawing Sheet

METHOD OF INK-JET PRINTING AND AN INK-JET PRINTING HEAD FOR CARRYING OUT THE METHOD

FIELD OF THE INVENTION

The present invention relates to office facilities, in particular to printing apparatuses. More concretely the invention relates to methods of inkjet printing and printing heads for such printing, serving for noncontact application of information onto different types of carriers—paper, film, plastics, etc.

BACKGROUND ART

A method of ink-jet printing is known which comprises placing an information carrier opposite jets filled with an expendable liquid printing material, and generating pressure pulses in those jets for feeding the printing material by portions onto the information carrier (U.S. Pat. No. 4,580,148, class 346/140R). In the known method a pressure pulse is created in the jets due to pulse heating of the liquid printing material which results in the formation of steam in the heating zone, rapid expansion of the liquid and the expulsion of droplets of the liquid from the jet.

A disadvantage of this method is that a source of thermal action on the liquid printing material is placed directly in each jet and is controlled from outside, which makes realization of this method difficult when there are a large number of jets. Furthermore, this method does not make it possible to obtain a high frequency of expulsion of droplets, since before the generation of a subsequent pressure pulse it is necessary to reduce the temperature in the jet for the flow therein of the next portion of liquid printing material.

An inkjet printing head realized according to the patent cited above comprises the same number of resistors for heating the liquid material as there are jets therein. Each resistor has a lead for connecting it to a voltage source. In order to expel droplets from one or another jet, the power supply circuit of a corresponding resistor is closed. When a current pulse flows through that resistor, it is heated, the liquid substance in the zone in which the resistor is positioned is heated to a steam state, as a result of which the liquid, expanding, creates an impact pulse expelling a droplet through the jet. Then, after the liquid has cooled, the described process can be repeated.

A disadvantage of such heads is their structural complexity, since the number of resistors should correspond to the number of jets mounted with a small spacing therebetween and provided with a system of current leads; low resolution since the aforesaid jets with resistors cannot be positioned with a small spacing; low reliability, since the mode of multiple pulse heating of resistors to a sufficiently high temperature predetermines their limited service life; low productivity since the next expulsion of droplets from a jet is only possible after the temperature therein has been reduced and there is a flow therein of the next portion of expendable liquid printing material.

DISCLOSURE OF THE INVENTION

The object at the base of the invention is to create such a method and such a head for ink-jet printing which would eliminate the arrangement directly in the head of a source of impact pulses for expelling a droplet of color liquid from its jets, simplify the construction of the head, enhance the reliability and service life, increase the resolution and speed.

This object is achieved in a method of ink-jet printing consisting of placing an information carrier opposite jets filled with an expendable liquid printing material and generating pressure pulses in those jets for feeding the printing material by portions onto the information carrier, in that in accordance with the invention, it further comprises the steps of using jets which have one blind end at the side opposite to the location of the information carrier, and focusing a light beam from a quantum generator onto the expendable liquid printing material from the direction of a jet's open end, in front of which a carrier is situated, to generate pressure pulses ensuring the expulsion of a droplet of the material onto the carrier.

With such a method, the source of impact action on the expendable liquid printing material is outside the jet, which simplifies the possibility of its realization where there are a large number of jets.

It is advisable that the beam of the quantum generator be directed at an angle to the surface of the liquid printing material which is in the jet, between the end of the jet and the information carrier.

With such a method, expulsion of droplets of the material from the jet is ensured along its axis independent of the angle of incidence of the light beam from the quantum generator onto the surface of the liquid material in the jet, which makes it possible for the carrier and jet to converge and to direct the light beam from the quantum generator between them to the jet.

It is advisable that a carrier be used which is transparent for the predetermined wavelength radiated by the quantum generator and that the light beam from the quantum generator be directed through it to the liquid printing material in the jet.

With such a method, maximum convergence between the carrier and jets with liquid printing material is ensured and its realization is simplified.

The stated object is also achieved in a ink-jet printing head comprising rows of jets filled with a expendable liquid printing material, means for feeding the printing material into the jets, means for generating a pressure pulse in the jets for feeding that material onto the information carrier in portions, in that in accordance with the invention, jets with one blind end are formed in the body of a drum made to rotate, their open ends are located on its surface in rows, the axis of each jet at the point of outlet onto the surface of the drum is positioned at a tangent thereto, the means for feeding the expendable liquid printing material into the jets is made with the possibility of filling the jets through the open ends, and the means for creating a pressure pulse in the jets comprises a quantum generator generating a light beam with an apparatus for focusing it on the expendable liquid printing material from the side of the open ends of the jets, in front of which the carrier is positioned, and an apparatus for deflecting the light beam over those ends.

With such a realization of the ink-jet printing head, its construction is simplified, since elements for impact action on the liquid material are not present in the jets of the head; reliability of its operation is enhanced due to simplification of the construction and the removal therefrom of parts operating in a mode of abrupt temperature differences; resolution of the head is enhanced since the diameter of the jets may be reduced to the diameter of the light beam of the quantum generator, and the spacing between the jets may also be reduced in practice to a magnitude somewhat exceeding the diameter of the jets, i.e. the resolution of the head approaches the theoretically possible value; the speed is increased since due to rotation of the drum with the jets, rows of jets already filled with expendable liquid printing material will be successively delivered to be affected by the light beam of the quantum generator.

It is advisable that the blind bases of the jets be made in the form of spheres.

Such a realization of the head will promote a more effective expulsion of droplets of material onto the carrier after the light beam of the quantum generator has entered the jet.

It is advisable that the means for feeding the expendable liquid printing material into the jets contain a bath with this material, a driving roller transferring the material from the bath onto the surface of the drum when it rotates in order to fill the jets, and a knife removing surplus ink from the surface of the drum.

Such a realization of the drum makes it possible to rapidly and easily fill the jets, excluding the dependence of the supply of liquid material therein on the temperature in the jets after the expulsion of droplets.

It is advisable that the light beam of the quantum generator be directed at an angle to the surface of the liquid printing material in a jet between the end of the jet and the information carrier.

Such a realization of the head makes it possible to ensure the expulsion of droplets of material from the jet along its axis independent of the angle of incidence of the light beam of the quantum generator onto the surface of the liquid material in a jet and to simplify its construction.

It is advisable that the information carrier be made transparent for a predetermined wavelength radiated by the quantum generator and be placed in the path of its light beam to the surface of the expendable liquid printing material in a jet.

Such a realization of the head makes it possible to converge the carrier and jet to a maximum degree and to create a compact construction thereof.

BRIEF DESCRIPTION OF THE DRAWINGS

The invention will further be explained by a description of concrete, non-restrictive, embodiments of the instant invention and by the appended drawings, wherein.

BEST METHODS OF CARRYING OUT THE INVENTION

The proposed method of ink-jet printing is carried out in the following manner.

Figure 1:
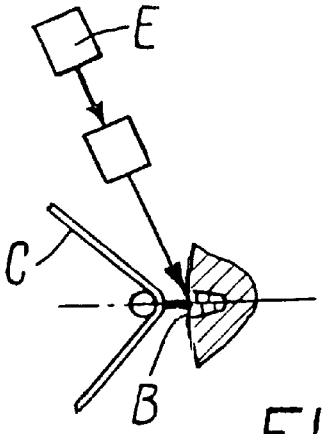
FIG. 1 shows the proposed method of ink-jet printing with the light beam of a quantum generator directed at an angle to the surface of liquid material in a jet.

An information carrier C (FIG. 1) is placed opposite jet B which is filled with expendable liquid printing material. Then a light beam of a quantum generator E is focused on the liquid printing material. In accordance with the discovery of the "Light-hydraulic effect" (Diploma No. 65 of the BI No. 19, 1969), an impact pulse is produced when a light beam of a quantum generator is absorbed inside a liquid. Using this effect, an impact pulse is created directly in jet B filled with a liquid printing material, as a result of which droplets of the liquid fly out of the jet and impinge on the information carrier.

Figure 2:
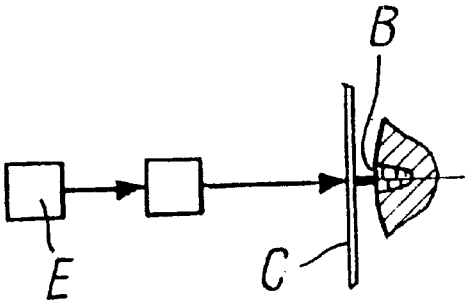
FIG. 2 shows the proposed method of ink-jet printing where the light beam of a quantum generator passes to the surface of the liquid material in a jet through a carrier which is transparent in respect of the wavelength of the beam.

In a similar manner droplets of the liquid impinge on the information carrier when the light beam passes to the surface of the liquid material in the jet B through a carrier which is transparent in respect of the wavelength of the beam (FIG. 2).

It is obvious from the description of the proposed method provided above that the source of impact action on the liquid material is outside the jet, which makes it possible to enhance the quality of printing by reducing the diameter of the droplets and increasing the density at which they are disposed on the information carrier.

Figure 3:
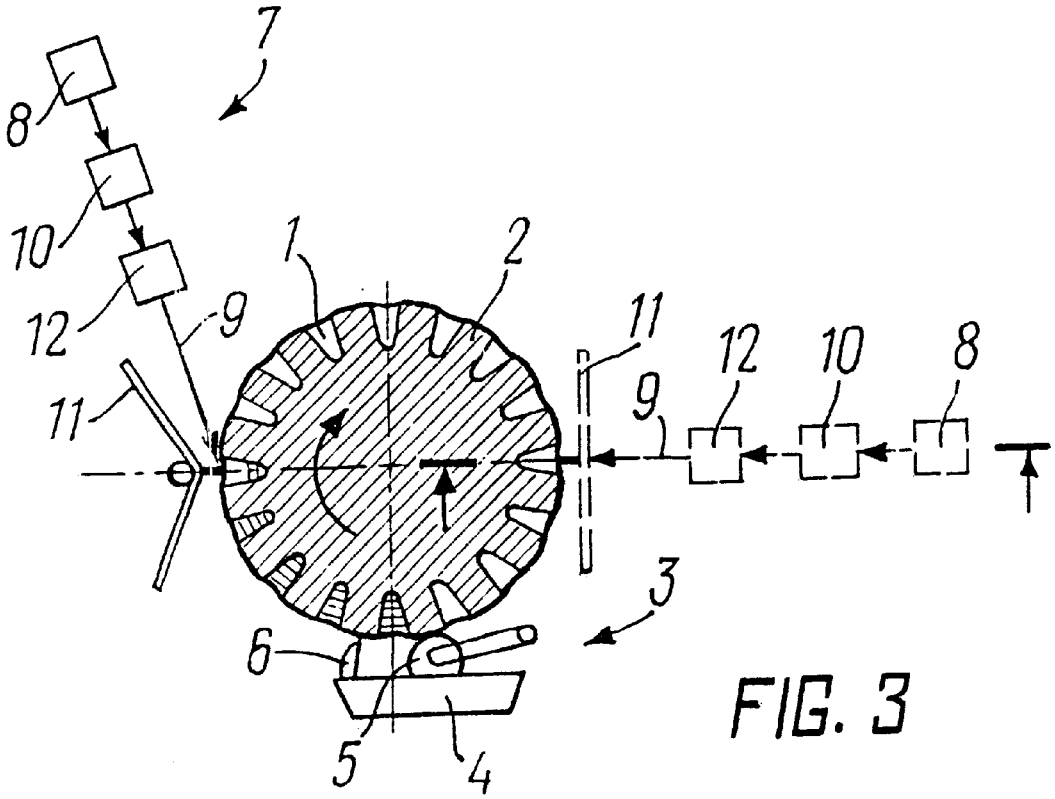
FIG. 3 shows a general view of the proposed ink-jet printing head. The dotted line shows one of the possible variants of passage of the light beam of the quantum generator to the jets with liquid material.
Figure 4:
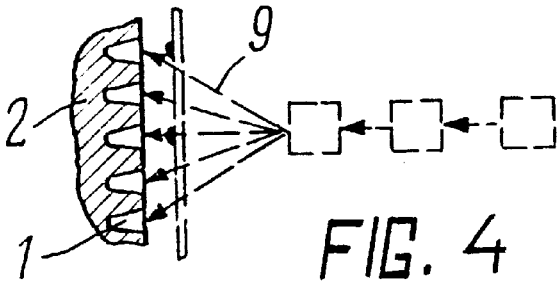
FIG. 4 shows a view along the section designed by the arrows in FIG. 3.

In order to carry out the proposed method of ink-jet printing it is necessary to ensure that the jets are filled with expendable liquid printing material and that the light beam of the quantum generator be deflected over the open end faces of the jets. This is carried out by means of the ink-jet printing head shown in FIG. 3.

The proposed ink-jet printing head comprises rows of jets, each with one blind end, which are formed in the body of a drum 2 provided with a rotation drive (not shown in the drawings). The open ends of the jets 1 are positioned on the surface of the drum 2 in rows. The axis of each jet at the point of outlet on the surface of the drum 2 is positioned on a line tangent to it. The blind bases of the jets 1 are made in the form of spheres. Means 3 for feeding expendable liquid printing material to the jets 1 is made with the possibility of filling them through the open end and comprises a bath 4 with that material. a drive roller 5 bathing in the material in the bath 4 and pressing against the surface of the drum 2, and a knife 6. Means 7 for creating a pressure pulse in the jets 1 comprises a quantum generator 8 of a light beam 9 with a device 10 for focusing that beam onto the expendable liquid printing material from the side of the open ends of the jets 1, in front of which a carrier 11 is disposed, and a device 12 for deflecting the light beam 9 over those ends.

The proposed ink-jet printing head operates in the following manner.

When the drum 2 and the roller 5 rotate, the expendable liquid printing material fills the jets 1 through their open ends. The rows of jets 1 filled with liquid material enter the zone in which the carrier 11 is positioned. In accordance with a predetermined program, the beam 9 of the quantum generator 8 is focused by means of device 10 onto the liquid material from the direction of the open ends of corresponding jets of a concrete row. When the light beam 9 is absorbed inside the liquid of corresponding jets 1, a light-hydraulic effect is created, as a result of which an impact pulse is created, which is intensified by the sphere of the blind ends of those jets, and droplets of liquid are transferred from those jets onto the carrier 11. Then the rotating drum 2 brings the next row of jets 1 under the scanning of the beam 9 and the described process is repeated until a combination of spots comprising a text or image appears on the carrier during the joint movement of the carrier 11 and rotation of the drum 2.

The principle of operation of the proposed head does not depend on whether the beam 9 of the quantum generator 8 impinges on the liquid in the jet 1 at an angle between the carrier 11 and the surface of that liquid in the jet or through a carrier 11 which is transparent in respect of the wavelength of the beam.

INDUSTRIAL APPLICABILITY

The purpose of the ink-jet printing head is to provide visual representation of textual and graphic information on carriers of any type with high resolution and at high speed.

What is claimed is:

1. A method of ink-jet printing comprising providing a jet having an open end and a blind end and filled with an expendable liquid printing material, providing a quantum generator disposed exterior to and opposite the open end of the jet, positioning an information carrier adjacent the open end of the jet and focusing a beam of light from the quantum generator onto the expendable printing material in the jet so as to generate pressure pulses insuring the expulsion of a droplet of material from the jet onto the information carrier.

2. A method of inkjet printing according to claim 1, in which the expendable printing medium in the jet has a surface at the open end of the jet and the light beam is focused on the surface of the material at an angle to that surface.

3. A method of ink-jet printing according to claim 2, in which the information carrier is positioned between the jet and the quantum generator and the light beam is focused on the liquid printing material through the information carrier and wherein the light beam has a wavelength to which the information carrier is transparent.

4. A method of ink-jet printing according to claim 3, in which the blind end of the jet is hemispherical.

5. A method of ink-jet printing according to claim 1, in which the information carrier is positioned between the jet and the quantum generator and the light beam is focused on the liquid printing material through the information carrier and wherein the light beam has a wavelength to which the information carrier is transparent.

6. A method of ink-jet printing according to claim 5, in which the blind end of the jet is hemispherical.

7. A method of ink-jet printing according to claim 1, in which there are a plurality of jets and the light beam is focused on the liquid printing material in at least two of said jets.

8. A method of ink-jet printing according to claim 7, in which the plurality of jets are disposed on a rotatable drum and the light beam is focused on the liquid printing material in jets sequentially as the drum rotates.

9. An ink-jet printing head comprising a rotatable drum, a plurality of jets each of which extends from an open end at the surface of the drum to a blind end in the interior of the drum, the longitudinal axis of each jet at the open end thereof positioned tangent to the surface of the drum, a expendable liquid printing material supply adapted to convey expendable liquid printing material into the jets through the open ends thereof, a quantum generator disposed exterior to the drum, a lens adapted to focus light generated by the quantum generator on material in the jets and a light beam deflector adapted to deflect light from the quantum generator over the open ends of the jets.

10. An ink-jet printing head according to claim 9, in which the blind end of the jets are hemispherical.

11. An ink jet printing head according to claim 10, in which the supply comprises a transfer roller adapted to transfer material from the supply onto the surface of the rotatable drum and into the jets, and a knife adapted to remove ink not in the jets from the surface of the drum.

12. An ink-jet printing head according to claim 11, in which the lens and deflector are disposed to direct a beam of light from the quantum generator to a surface of liquid printing material in a jet at an angle to said surface.

13. An ink-jet printing head according to claim 12, wherein the quantum generator is adapted to generate a light beam of a given wavelength and said head further having an information carrier transparent to that given wavelength disposed in the path of the light beam between the generator and the surface of the expendable liquid printing material in the jet.

14. An ink-jet printing head according to claim 9, in which the lens and deflector are disposed to direct a beam of light from the quantum generator to a surface of liquid printing material in a jet at an angle to said surface.

15. An ink-jet printing head according to claim 9, wherein the quantum generator is adapted to generate a light beam of a given wavelength and said head further having an information carrier transparent to that given wavelength disposed in the path of the light beam between the generator and the surface of the expendable liquid printing material in the jet.

* * * * *